US005399204A

United States Patent [19]

Campo et al.

[11] Patent Number: 5,399,204

[45] Date of Patent: Mar. 21, 1995

[54] AQUEOUS CLEANING METHOD

[75] Inventors: Theodore J. Campo, Somerville; Donald R. Chaulk, Needham; William J. Felton, Roslindale; Manohar S. Grewal, Hanover; John A. Hindley, Abington; John F. Krantz, Wollaston; Mark D. Lincoln, Taunton; Kevin P. McDonough, West Roxbury; James W. Walsh, Wellesley Hills, all of Mass.

[73] Assignee: The Gillette Company, Boston, Mass.

[21] Appl. No.: 628,883

[22] Filed: Dec. 18, 1990

[51] Int. Cl.[6] ..... B08B 3/04

[52] U.S. Cl. ..... 134/26; 134/30; 134/37

[58] Field of Search ..... 134/1, 15, 10, 26, 30, 134/34, 35, 37

[56] References Cited

U.S. PATENT DOCUMENTS

| | | | |
|---|---|---|---|
| 3,868,272 | 2/1975 | Tardoskegyi | 134/26 |
| 3,958,586 | 5/1976 | Schnelle | 134/68 |
| 4,000,002 | 12/1976 | Olson | 134/26 |
| 4,076,554 | 2/1978 | Weihe | 134/10 |
| 4,228,813 | 10/1980 | Noren | 134/47 |
| 4,319,930 | 3/1982 | Yano et al. | 134/10 |
| 4,437,479 | 3/1984 | Bardina et al. | 134/68 |

*Primary Examiner*—Melvyn J. Andrews
*Assistant Examiner*—Saeed Chaudhry
*Attorney, Agent, or Firm*—Donal B. Tobin

[57] ABSTRACT

A machine for removing oil, dirt and grinding debris from a metal surface comprises a plurality of wash, rinse and dry stations separated to prevent contamination carryover from one station to the next. Razor blades in stacks are passed through the stations, the stacked blades being mounted on rods supported by a fixture and the nozzles or jets within the machine being so oriented as to cause a riffling of the blades due to water or air pressure. A purified water rinse and preferably an aqueous cleaning solution are employed in the machine and are circulated through the stations by a flow system which provides efficient and economical usage of the cleaning solution and rinse materials.

3 Claims, 9 Drawing Sheets

AQUEOUS CLEANING METHOD

BACKGROUND OF THE INVENTION

The present invention relates to a machine and method for the cleaning of metallic articles, and more particularly to a machine and method for the treatment of razor blades during the manufacturing process to remove contaminants from the blade surface prior to the step of applying a coating thereto by sputtering, or other process.

Presently, a great number of wash systems are employed to produce metallic surfaces free from contamination. These wash systems generally employ various halogenated hydrocarbons and non-halogenated hydrocarbons, of significant quantity industry wide for cleaning and degreasing of the metal surfaces, and the degree of success with each of these wash systems is generally dependent upon the degree of cleanliness required of the resultant surface. Particularly in the manufacture of razor blades, there is a need to remove sharpening fluids, swarf and grinding wheel related debris from the blade body as well as the critical removal from the blade edges which are subsequently subjected to a coating process. The degree of cleanliness of a razor blade is ultimately determined by examination of the blade employing high magnification such as a 750 power microscope.

Recently, the various metal cleaning systems previously employed have come under scrutiny in view of the materials employed, and in particular, the environmental impact from the usage of the various materials.

Although the halogenated hydrocarbon solvents are widely used in industry for metal cleaning, their medical, environmental and cost factors coupled with waste disposal problems are negative aspects in their usage.

The non-halogenated hydrocarbon solvents on the other hand are generally flammable, have high volatility and dubious ability to be recycled for continuous use. These, plus unfavorable medical, environmental and cost factors, put this group of solvents in a category which is unattractive for practical consideration.

In order to eliminate the various negative aspects of the known chemical washing and degreasing systems, it has, therefore, been suggested that an aqueous detergent system would overcome some of the inherent negative aspects of prior art chemical systems.

It is, therefore, an object of the present invention to provide a machine and method for removing contamination from the surface of an article such as a razor blade which employs a predominantly aqueous based cleaning composition as the cleansing medium.

Another object of the invention is to provide a machine and method for removing contamination from the surface of an article which is adaptable to mass production techniques.

A further object of the invention is to provide a machine and method of the type set forth above which provides a cleanliness of the metallic surface sufficient to allow a coating of the surface by a process such as sputtering and/or subsequent polymeric coating.

Yet another object of the invention is to provide a machine and method for removing contamination from the surface of an article which is economical to use and which is an improvement from an environmental consideration, over those systems in use today.

A further object of the invention is to provide a clean surface on a metallic surface without leaving any detrimental residual processing stains such as surfactant residue, water or oil stains.

SUMMARY OF THE INVENTION

The above objects as well as other objectives which will become apparent as the description proceeds are achieved by providing a machine having a cabinet structure forming a plurality of separate substantially enclosed compartments, each having an opening to provide access to the adjacent compartment. A first compartment has a plurality of nozzles disposed therein for directing a pre-wash fluid inwardly of the compartment. A second compartment is disposed adjacent to the first compartment also having a plurality of nozzles for directing a wash fluid inwardly of the second compartment. A third compartment located adjacent the second compartment has a plurality of nozzles which direct rinse fluid inwardly of the third compartment and a fourth compartment disposed adjacent to that compartment has a plurality of nozzles which direct final rinse fluid inwardly of the fourth compartment. Means is provided for circulating fluid through the nozzles for application to the surface of an article in the fourth compartment and thereafter circulating the applied fluid which has been drained from the fourth compartment, through the nozzles in the third compartment and thereafter circulating the applied fluid drained from the third compartment through the nozzles in the first or pre-wash compartment.

Means is provided for moving the article through the first, second and third compartments and a separate means is provided for moving the article through the fourth and subsequent compartments.

The fluid provided to the fourth compartment is generally a purified non-contaminated water which is heated to a temperature in the range of 140° F. to 160° F., and the wash fluid which is provided at the second compartment is an aqueous based cleaning composition, which is generally heated to a temperature in the range of 140° F. to 165° F.

In applying the process to razor blades, the blades are generally stacked and placed on a support with the blade surface being oriented towards the path of movement through the various compartments. The blades are so disposed on the support that a nozzle in a compartment directs fluid towards the edge, or at substantially right angles to the surface, of a blade in the stack causing the blades to riffle as they are passed through the compartments and past the nozzles which are so directed.

In order to prevent the blades from adhering one to the other and to enhance the riffling of the blades, the stack is passed through a demagnetizing device prior to entry into the first compartment.

In order to insure complete removal of the liquid and any contaminants contained in the liquid from the article, a plurality of drying compartments are disposed in alignment adjacent the fourth compartment and at least one of the drying compartments contains a plurality of nozzles disposed therein for directing air under pressure inwardly of the compartment and at least one of the drying compartments contains a heat radiating means for directing radiation inwardly of the compartment. In the drying step, employed with the aforementioned stack of razor blades, the nozzles again direct the flow of air towards the edge, or substantially at right angles to the surface of a blade in the blade stack and riffling of the blades occurs to aid in removing droplets of fluid which may contain contaminants.

BRIEF DESCRIPTION OF THE DRAWINGS

The foregoing and other features of the invention will be more particularly described in connection with the preferred embodiment, and with reference to the accompanying drawing wherein.

DESCRIPTION OF THE PREFERRED EMBODIMENT

Figure 1:
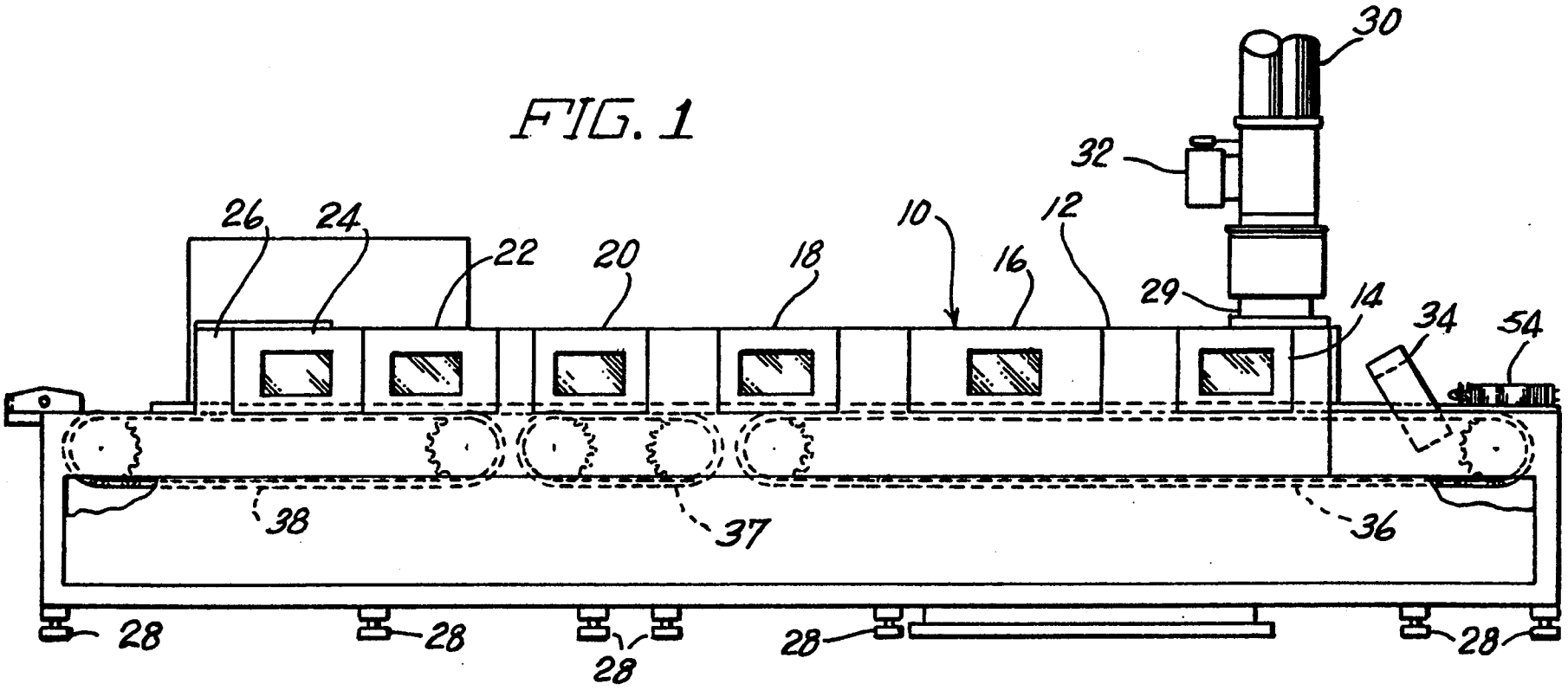
FIG. 1 is an elevational frontal view, partially in section, showing an aqueous wash machine constructed in accordance with the teachings of the present invention.
Figure 2:
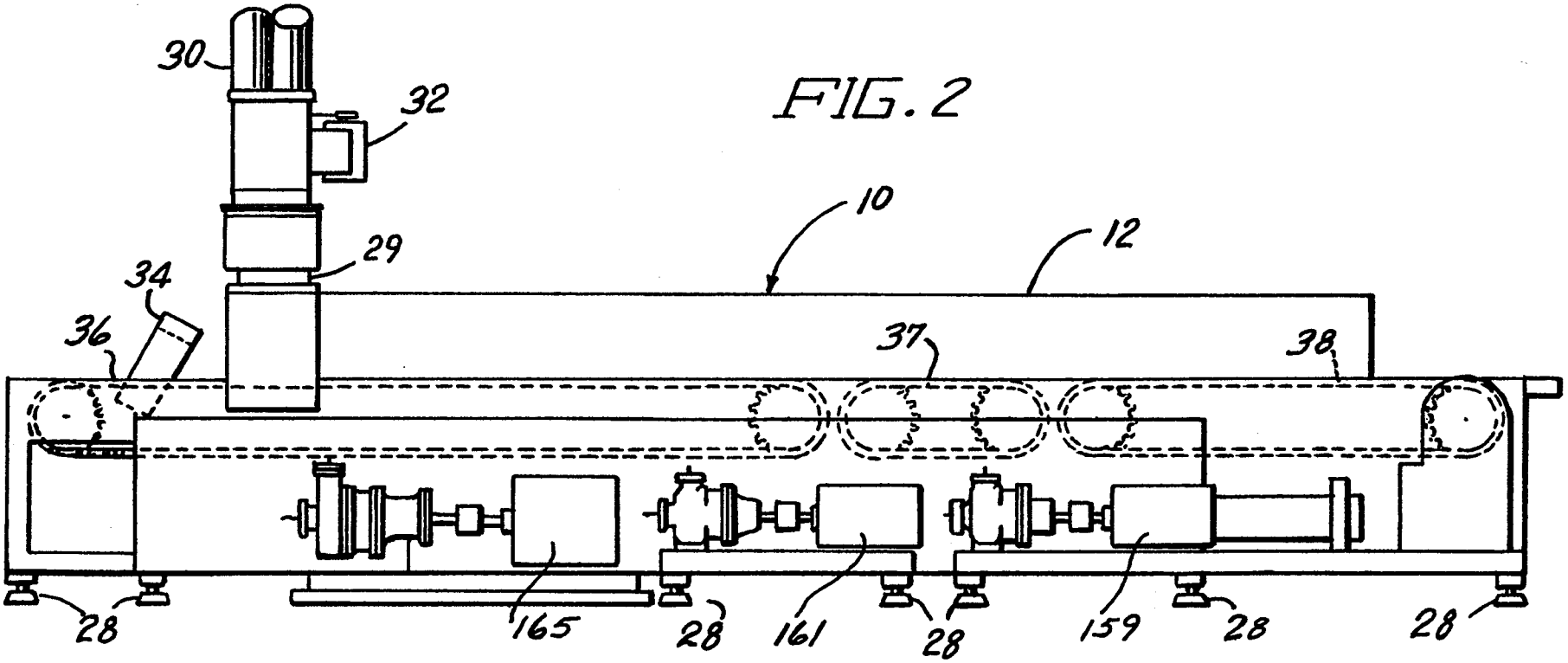
FIG. 2 is an elevational rear view similar to FIG. 1, showing the structure of FIG. 1, partially in section, and partially in schematic to reveal details of the aqueous wash machine.
Figure 3:
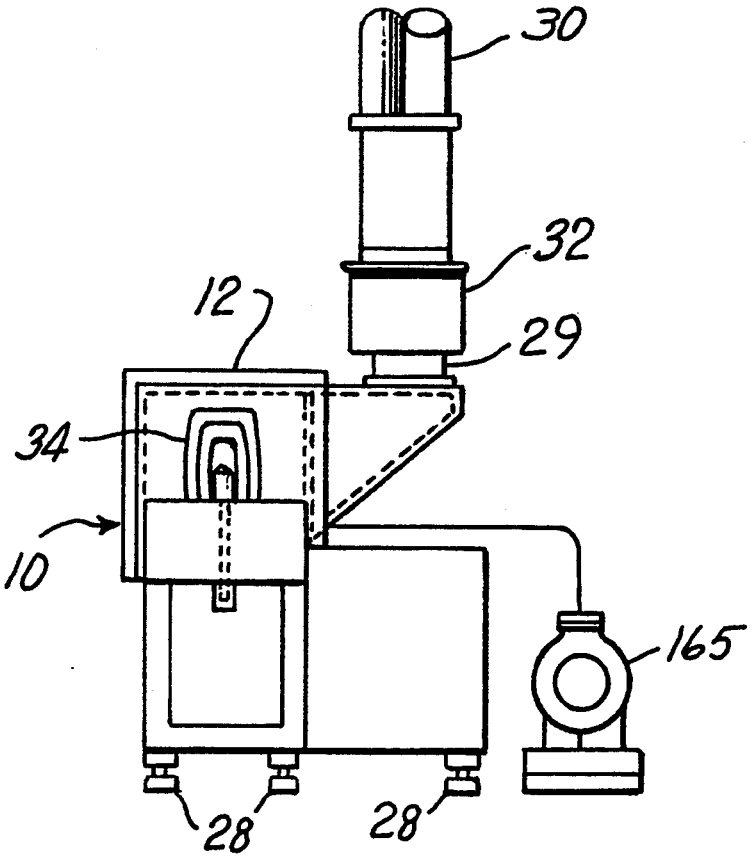
FIG. 3 is a left side elevational view of the structures of FIGS. 1 and 2 showing further details of the invention.
Figure 4:
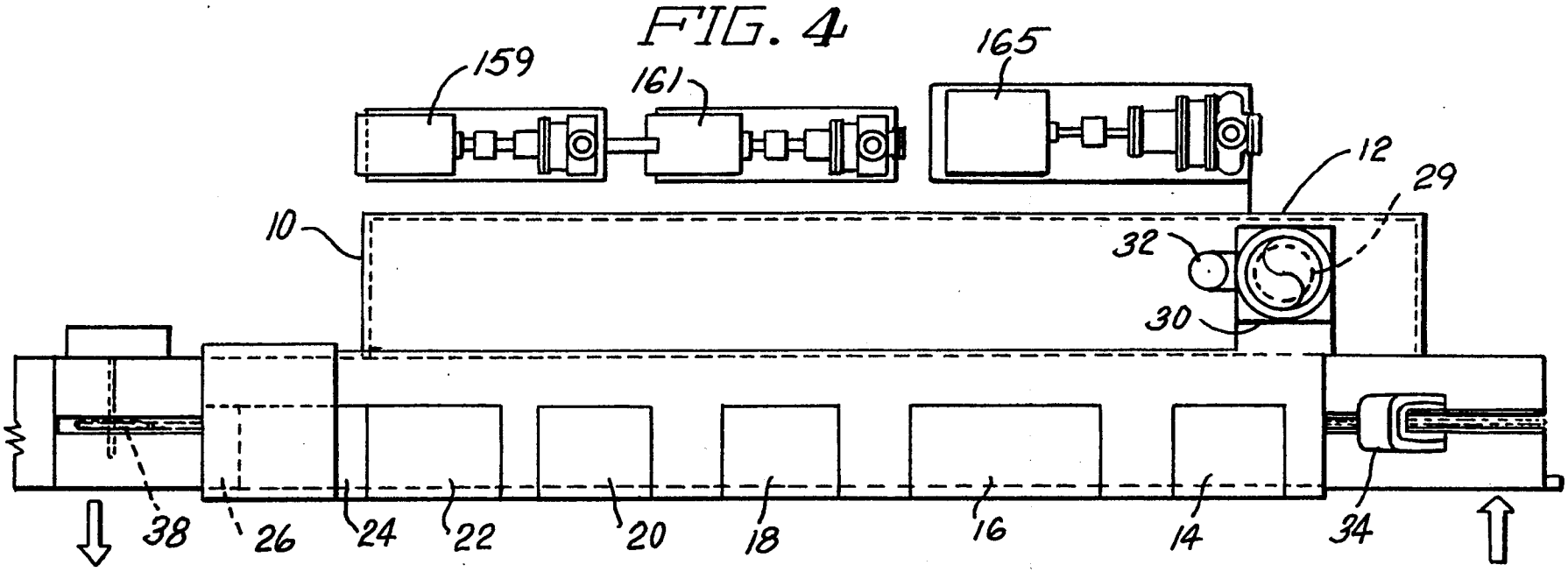
FIG. 4 is a top plan view partially in schematic and showing the structure of FIGS. 1 through 3 in greater detail.

Referring now to the drawing and in particular to FIGS. 1 through 4, there is shown an aqueous wash machine 10 comprising a cabinet 12 having a wall structure forming a plurality of separate, substantially enclosed, work stations which comprise a pre-wash compartment 14, a wash compartment 16, a rinse compartment 18, a final rinse compartment 20, air drying compartment 22, a radiant heat drying compartment 24 and an air drying station 26. The cabinet 12 is mounted on a plurality of vibration pads 28 and a vent system comprising conduits 29 and 30 and a motor driven fan unit 32 is mounted onto the top of the cabinet 12 having an inlet of the conduit 29 opening adjacent the pre-wash compartment 14.

A demagnetizing unit 34, which may be of any type well known in the art effective to demagnetize metals, is mounted on the cabinet 12 adjacent to the pre-wash compartment 14 in spaced relation with a continuous belt in the form of a chain 36. A separate chain 37 extends from one end of the chain 36 to a point adjacent the entrance to the air drying compartment 22 and is driven in the same direction as the chain 36 to move items through the compartment 20, while a third chain 38 moves through compartments 22 through 26, which will be evident as the description proceeds. Chain 38 is driven by a motor (not shown) and chains 37 and 36 are mechanically connected by a drive mechanism which causes each to be driven in response to operation of chain 38.

When employing the aqueous wash machine 10 to remove contaminants from razor blades which have been sharpened, a fixture 40 is provided which is moved through the plurality of stations by the chains 36, 37 and 38, as will be explained with reference to FIGS. 5 through 7.

Figure 5:
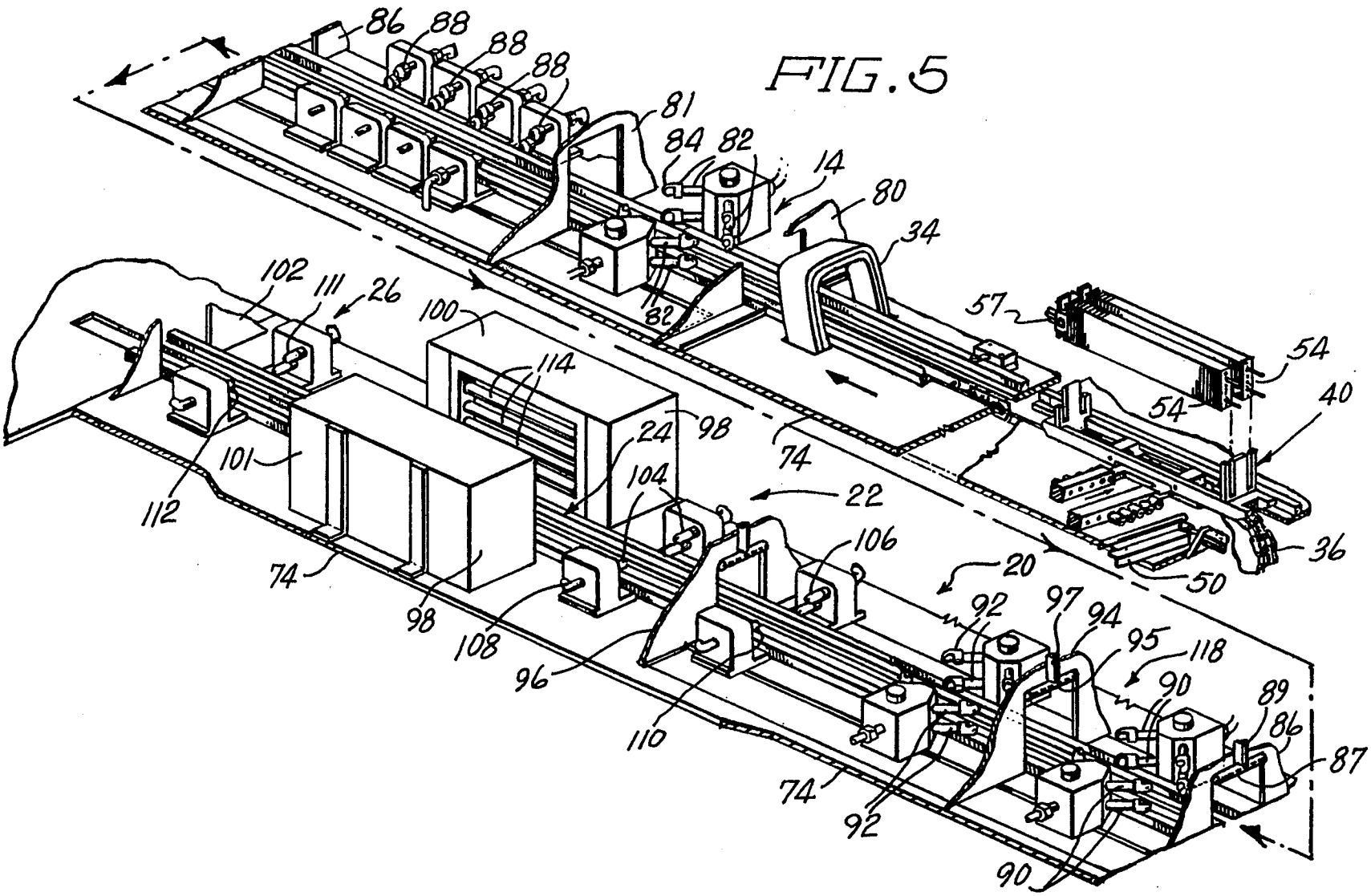
FIG. 5 is a fragmentary perspective view showing details of a portion of the structure of FIGS. 1 through 4, taken on an enlarged scale for clarity.
Figure 6:
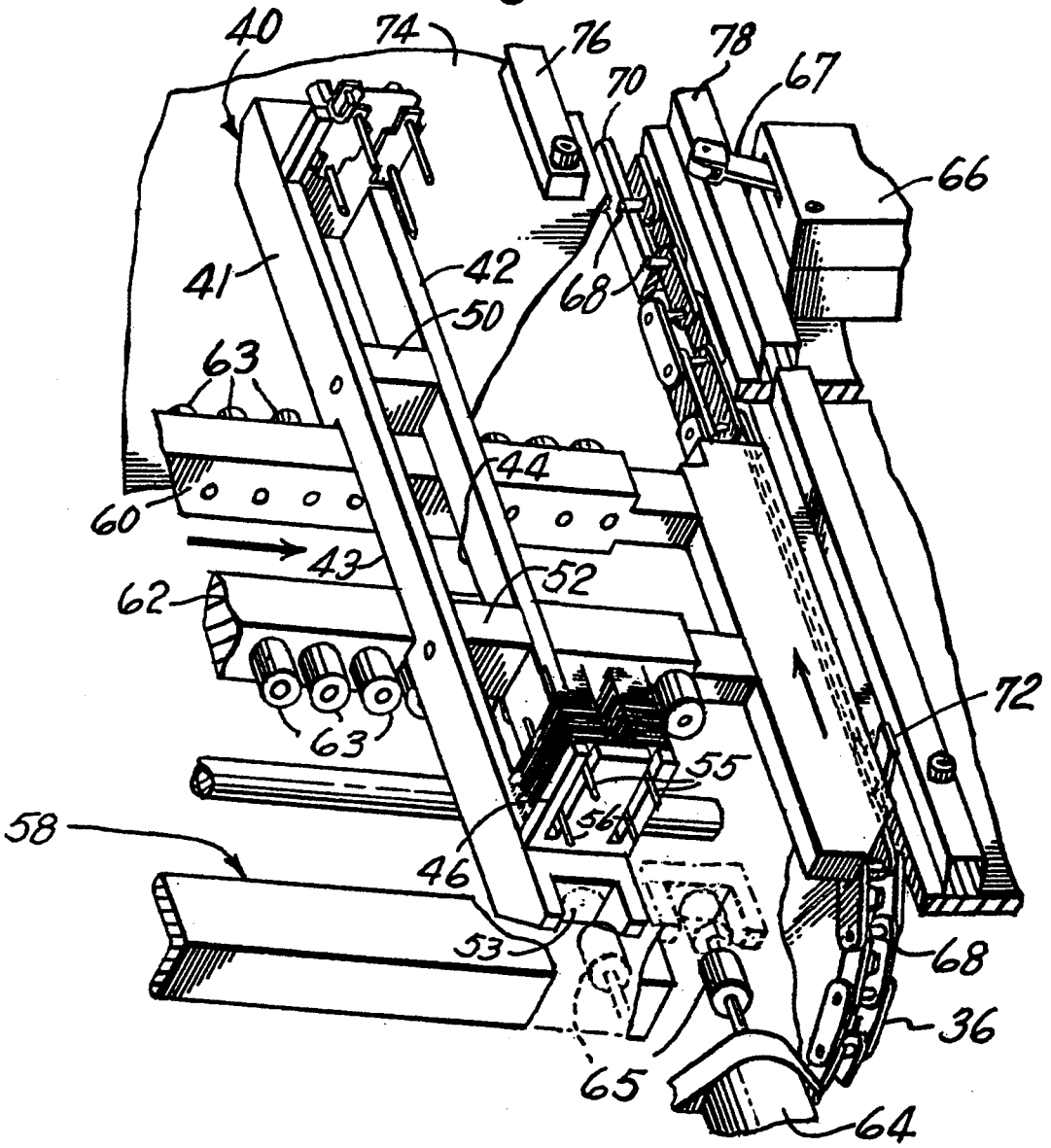
FIG. 6 is a fragmentary perspective view showing details of the feeding mechanism embodied in the structure of FIGS. 1 through 5, taken on an enlarged scale for clarity.
Figure 7:
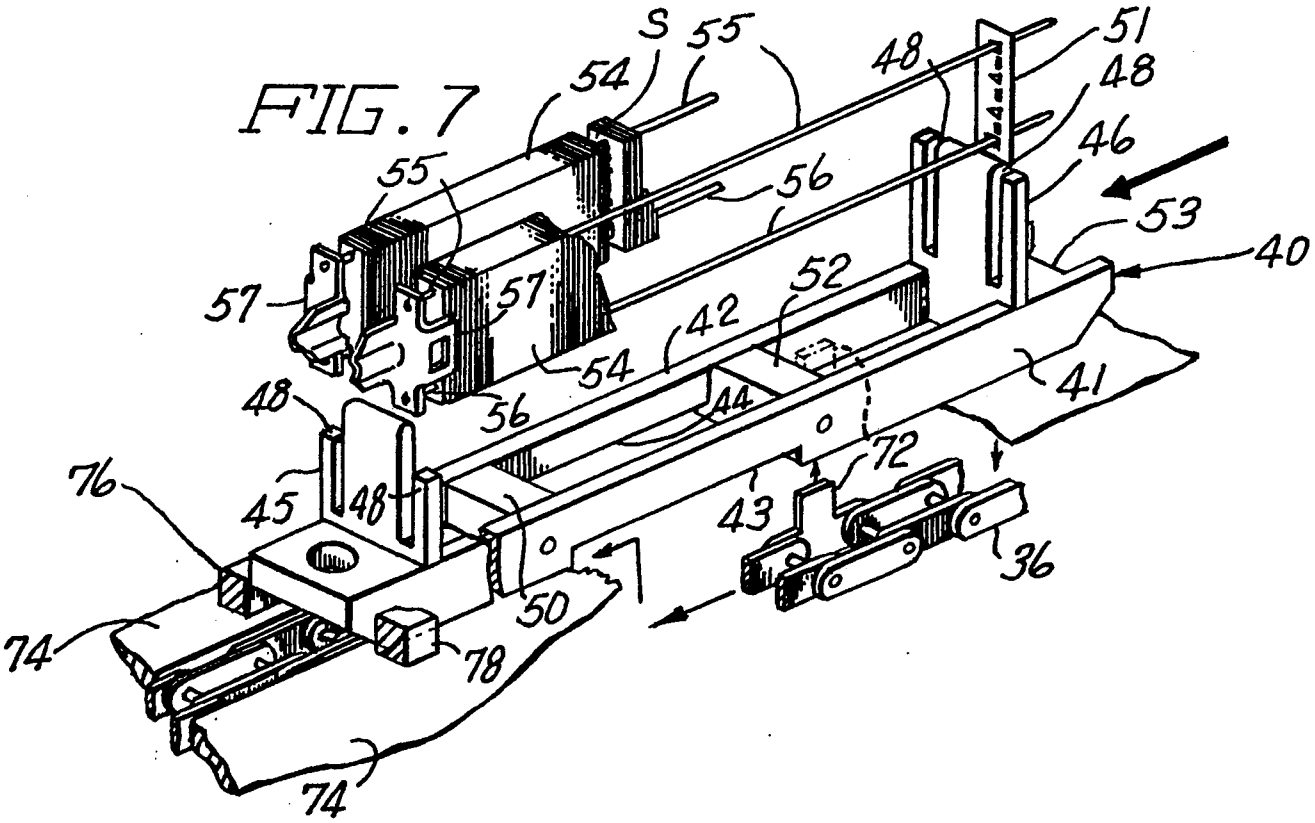
FIG. 7 is a fragmentary perspective view, partially in section, showing details of the device for retaining razor blades in the aqueous wash machine of FIGS. 1 through 6, taken on an enlarged scale for clarity of detail.

Referring now to FIGS. 5, 6 and 7, and in particularly to FIG. 7, the fixture 40 comprises a pair of side elements 41 and 42 each having a rectangular notch 43 and 44 formed in the bottom surface thereof. A pair of end walls 45 and 46 are provided with vertical slots 48 and a pair of cross members 50 and 52 are disposed between the side elements 41 and 42. Each blade 51 is received on a pair of rods 55 and 56 to form a stack 54 of blades. One end each of the rods 55 and 56 terminates at, and is mounted, on end member 57 having a surface facing of the blade stack 54 and the opposite end of each rod is free. The end member 57 is received in the slots 48 of the forward end of the fixture 40 and the free ends of the rods 55 and 56 are received in the slots 48 at the rear of the fixture 40.

An end cross member is located outside of the wall 46 and produces a notch 53 to be employed in manipulating the fixture 40.

It will be noted that the number of blades is chosen such that there is a space S separating the stack 54 of blades when disposed between the end walls 45 and 46 to insure a riffling action of the blades, which will be explained in further detail with regard to the washing process.

Referring now to FIG. 6, the fixture 40 is shown to be supported by feed structure 58 which comprises a pair of substantially rectangular beams 60 and 62, each having a plurality of rollers 63 extending outwardly from one side of the respective rail, in opposite directions. The rails 60 and 62 are spaced such that they are received in the rectangular notch 43 and 44 and the rails are of a length to provide for stacking a plurality of fixtures 40 side by side thereon.

A clamp cylinder 64 is provided adjacent the end of the fixture 40 having the end notch 53 disposed facing the clamp cylinder and the piston rod of the clamp cylinder is effective to extend a detent 65 into the end notch of the last aligned fixture 40. A limit switch 66 is disposed adjacent to the path of the chain 36 and has an arm 67 located for contact with the fixture 40 when disposed on the chain 36 at the point of loading. While the arm 36 remains in contact with a blade loaded fixture 40, the detent 65 remains within the notch 53 of the next to be loaded fixture. When the blade carrying fixture 40 being sensed by the arm 67 moves into the wash cycle, the arm extends and the clamp cylinder 64 retracts the detent 65 and extends outwardly to catch the next fixture 40, the released fixture rolling on the rollers 63 and taking its place above the chain 36 in contact with the arm 67.

As will be noted in FIG. 6, the chain 36 (as well as the chains 37 and 38) is of a variety having the links spaced apart by the link retaining pins 68 and an elongated bar 70 is disposed such that the pins 68 are supported therealong to prevent sagging of the chain during the length of travel through the cabinet 12. As best shown in FIG. 7, a plurality of pushers 72 are spaced along the length of the chains 36, 37 or 38 and extend through a slotted opening in the floor structure 74 of the cabinet 12 to contact a cross member 50, or 52 or the bottom of end wall 45 to move the fixture 40 between a pair of rectangular rails 76 and 78.

Referring now to FIG. 5, each of the work stations in the cabinet 12 are shown in detail, the first of which is enclosed by a pair of walls 80 and 81 having opening therein to provide access to the compartment and being dimensioned to allow the fixture 40, having razor blades supported as previously described, to pass through the walls 80 or 81. The compartment 14 contains four nozzles 82 disposed on one side of the track 36 and four nozzles 82 disposed on the opposite side of the track having openings generally directed towards the blade stack 54 as they travel through the compartment 14. Each of the nozzles 82 has a deflector portion 84 which is designed to deflect the fluid into a flat fan-shaped spray against the edges of a blade 54 in the stack, or substantially at right angles to the surface of a blade in the stack. By spacing the nozzles 82 from the blade stack 54 and directing the spray to produce a laminar flow at the point of contact with the blade stack 54, the blades are riffled as they travel through the spray, insuring that each blade receives a fluid pre-wash over substantially the entire surface of the blade. The demagnetizing device 34 disposed prior to compartment 14 insures that the blades are not attracted to one another, and therefore insures that the riffling of the blades, or the separation of each blade will take place during the spraying operation.

The fixture 40 is oriented such that the end member 57 is located at the forward end of the fixture to insure that fluid directed toward the blade stack 54 is not directed in the forward direction, toward a preceding chamber, but rather flows rearwardly through the blade openings and is discharged at the free ends of the rods 55 and 56.

Adjacent the pre-wash compartment 14 is the wash compartment 16 which is substantially enclosed by the walls 81 and 86. The wash station 16 contains eight nozzles 88 disposed on one side of the fixture 40 and eight nozzles of similar design disposed adjacent the opposite side of the fixture 40, as it carries the razor blade stack 54 through the compartment. In like manner, each of the nozzles 88 is constructed to apply a liquid spray in flat fan form at right angles to the surface of the blades in the stack 54 to cause the riffling effect, as mentioned with regard to the pre-wash spray of compartment 14.

After passing through the wash compartment 16, the blades in the stack 54 travel through a rinse compartment 18 and a final rinse compartment 20, each of similar design. The rinse compartment 18 contains four nozzles 90 disposed on one side of the fixture 40 and four nozzles 90 disposed adjacent opposite sides of the fixture 40 as it travels along the chain 36. The fixture 40 is picked up by the chain 37 and released by the chain 36 between the rinse compartment 18 and the final rinse compartment 20 by virtue of similar construction of the chains 37 and 36 in which the pusher 72 on the chain 36 drops from beneath the fixture and a pusher on the chain 37 is brought into place to contact the cross member 50 of the fixture. As will be noted, the final rinse compartment 20 is constructed similar to both rinse compartment 18 and pre-wash compartment 14 and contains eight nozzles 92 disposed adjacent the path of the fixture 40, both the nozzles 90 and 92 being oriented as previously described with regard to the nozzles 82 located in the pre-wash compartment 14. The compartment 18 is substantially enclosed by the walls 86 and 94 and the final rinse compartment 20 is substantially enclosed by the walls 94 and 96, the walls 94 and 96 being constructed similar to the walls 81 and 80 to substantially enclose a respective compartment and having an opening of limited size to provide for movement of the fixture 40 and blades in the stack 54 from one station to the other along the wash cycle path. A pair of air nozzles 106 are disposed on one side of the path of the fixture 40 and a second pair of air nozzles 110 are disposed on the opposite side of the path to initiate air drying as is conducted in compartments 22 and the remaining drying stations.

It will be further observed that the walls 86 and 94 are each provided with a tubular member 87 and 95 respectively, axially disposed across the respective access opening in each of the walls. The tubular members 87 and 95 each have a slotted opening running over substantially the length of the respective member and are connected to a pair of air lines 89 and 97 respectively. Air under pressure is conducted to the tubular members 87 and 95 through the lines 89 and 97, and is forced through the slotted openings in the members to form a curtain of air separating the wash compartment 16 from the rinse compartment 18, and the rinse compartment 18 from the final rinse compartment 20. The air is substantially oil and water free and of a temperature which is below that which the particular wash solution employed, would become dried to the blade surface. The air curtain produced is effective to prevent cross contamination from one chamber to another.

After passing through the wall 96, the razor blade stack 54 is subjected to drying stations which include the air drying compartment 22 disposed between the wall 96 and wall structure 98 formed by lamp holders 100 and 101. The lamp holders 100 and 101 are disposed adjacent to the path of the blades in the stack 54 forming a substantially enclosed radiant heat drying compartment 24, and the opposite end walls of the lamp holders 101 combine with wall 102 to form the air drying compartment 26. The air drying compartment 22 contains a pair of air nozzles 104 disposed on one side of the chain 38 and a second pair of air nozzles 108 disposed on the opposite side of the chain, or path of movement of the razor blade stack 54. In the final air drying compartment 26, a pair of air nozzles 111 and 112 are disposed one on either side of the path of movement of the blade stack 54, each of the air nozzles being constructed and disposed such that the air is blown substantially at right angles to the surface of the blade stack to produce the aforementioned riffling effect, as the blade stack passes through a respective compartment.

Transfer of the fixture 40 from the chain 37 to the chain 38 takes place between the compartments 20 and 22, and is accomplished in similar manner to that described above with reference to chains 36 and 37.

Each of the lamp holders 100 and 101 which form the radiant heat drying compartment 24 contains a plurality of heat lamps 114 in combination with a reflective surface to project radiant heat onto the razor blade stack 54 as they are passed through the compartment 24.

During the drying process taking place in the compartments 20 through 26, the riffling effect of the blades, in combination with the air pressure, to which the blades 54 are subjected in these air drying compartments, is effective to blow the moisture containing any contamination from the surface of the blades, rather than to evaporate the moisture. The residual adsorbed moisture, if present, is desorbed during the travel of the blade stack 54 through the compartment 24 where the blades are subjected to radiant heat emanating from the heat lamps 114, and driven from the blade surface by air blown onto the blade surface through the nozzles 111 and 112 in compartment 26.

Figure 8:
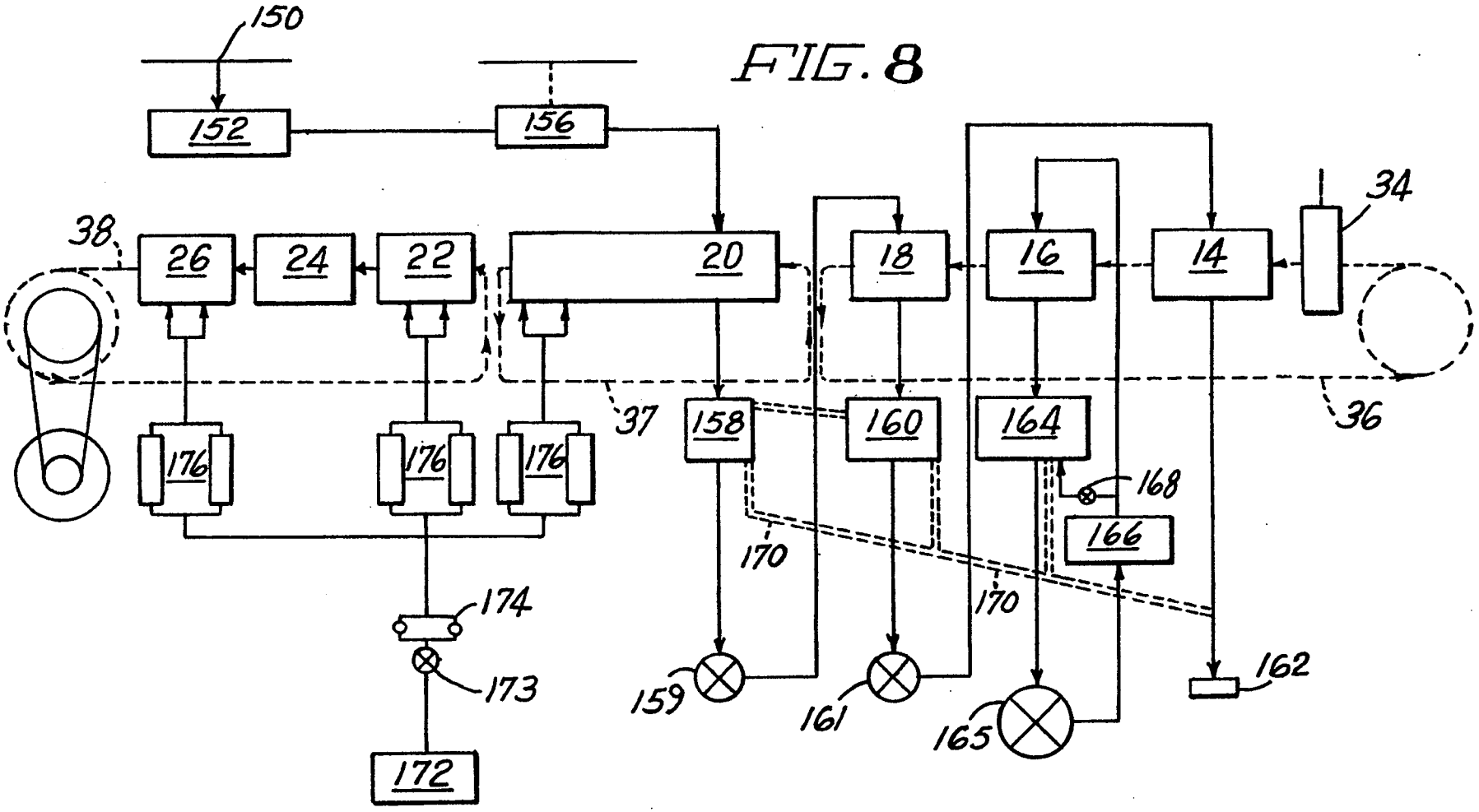
FIG. 8 is a process flow chart showing the various elements employed in the process performed during operation of the aqueous wash machine.

Referring now to FIG. 8 in the drawing, there is a simplified schematic of the liquid flow through the fluid application stage of the washing process. City tap water is supplied at an inlet 150 at approximately 15 gallons per minute and flows into a double pass reverse osmosis filter system 152, and then through a heat exchanger 156. The osmosis filter system 152 is a double pass system manufactured by Osmonics Inc., Minnetoka, Minn. and is given the designation 43 CHF-HR(PA)27K/DLX/DP which provides the desired purity of 1 to 3 megohms with allowable decay to 0.25 megohms. The steam heat exchanger 156 is generally provided with factory steam and is effective to raise the temperature of the fluid passing therethrough to a temperature between 140° F. to 160° F.

The purified water is sprayed onto the blades 54 traveling through the compartment 20, and the spent fluid is drained to a rinse tank 158. Thereafter, the fluid is forced onto the surface of the blades in the stack 54 by a pump 159 operating through the eight nozzles 90 disposed in the rinse compartment 18. After employment in the rinse compartment 18, the liquid is returned through the drains in the compartment 18 to a pre-wash tank 160 and thereafter forced under pressure by a pump 161 through the eight nozzles 82 provided in the pre-wash compartment 14. The fluid draining from the compartment 14 is now directed to a drain 162.

Wash tank 164 contains an aqueous based cleaning composition effective to remove oil, dirt and debris from the surfaces of articles passed through compartment 16. Preferred cleaning compositions for use in cleaning razor blades are aqueous cleaning solutions including a detergent or a combination of detergents and a non-ionic surfactant dispersed in water which is preferably deionized or purified by reverse osmosis treatment system 152. Preferred detergents are pyrophosphates and metasilicates. Other ingredients which can be included in the preferred cleaning solutions are anionic surfactant(s), especially sulfonates, and defoaming agents such as polyglycol sufactants. An especially preferred cleaning solution for razor blades is described below.

| Ingredient | % by weight (range) |
|---|---|
| Tetrapotassium pyrophosphate | 0.38–0.42 |
| Sodium metasilicate | 0.16–0.18 |
| Sodium xylene sulfonate | 0.23–0.27 |
| Thioether surfactant[1] | 0.40–0.45 |
| Defoaming agent[2] | 0.065–0.08 |
| Water | Remainder |

[1] An ethoxylated thioether having the formula $C_{26}H_{54}O_7S$ and sold under the trade name ALCODET MC-2000 by Rhone-Poulenc Inc., Cranbury, New Jersey.
[2] A polyoxypropylene-polyoxyethylene block copolymer sold under the trade name PLURONIC L-61 by BASF Corporation, Parsippany, New Jersey.

The cleaning solution is forced by a pump 165 from the wash tank 164 through a steam heat exchanger 166 which maintains the temperature of between 140° F. to 165° F. The solution is then forced at between 120 to 125 lbs per square inch through the openings of the nozzles 88 and onto the blades in the stack 54 as they pass through the compartment 16. A valve 168 is provided in the line leading to the nozzles 88 which allows the cleaning solution to recirculate through the tank 164 under back pressure created by the nozzles. Thus, the solution is recirculated through the tank 164 and the heat exchanger 166 until forced through the nozzles 88 and into the compartment 16 after which the solution is drained back to the wash tank 164. A network of overflow drains 170 shown in dotted lines is provided to insure that the tanks maintain a proper level, and any excess solution is directed to the drain 162.

The drying compartments 20, 22 and 26 are each provided with air from a factory air supply 172 which is regulated by a valve 173 to approximately 60 psi, and treated to be oil free and below 25% R.H. The regulated air is passed through a filter 174 to remove any particles that may be contained in the air supply. The air is then passed through a resistance heater 176 and the temperature is raised from between 135° F. to 150° F. prior to being forced through nozzles 111 and 112 in the compartment 26 and the nozzles 104 and 106 in the compartments 20 and 22.

Figure 9:
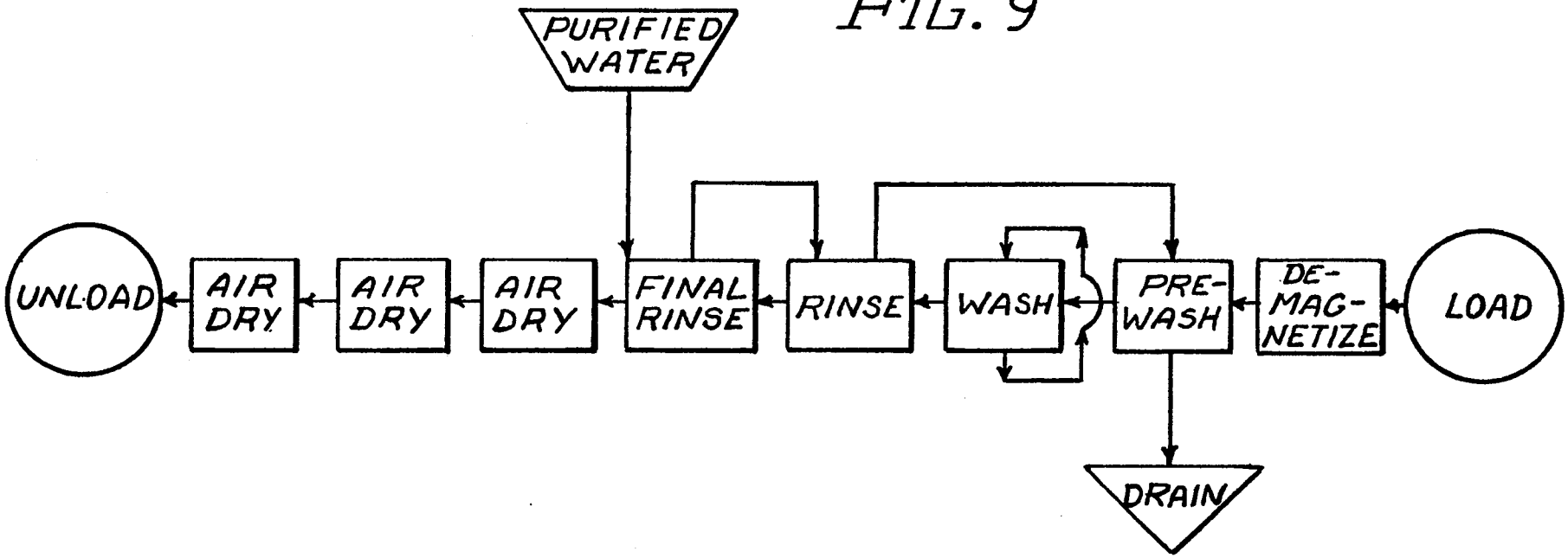
FIG. 9 is a simplified process diagram showing the steps of the process performed by the aqueous wash machine depicted in FIGS. 1 through 7.

To summarize the process for the which the aqueous wash machine 10 is employed, and with reference to FIG. 9, the razor blade stack 54 is received on a fixture 40 having approximately 12 inches between the end walls 45 and 46 accommodating approximately 3000 blades. A one-quarter inch space S is intentionally left along the stack 54 to allow the blades 54 to riffle during processing so that wash, rinses and air can act on each blade individually. This characteristic has proved to be extremely important in successfully cleaning each individual blade in the blade stack 54. The blade stack 54 is then loaded at a load station wherein a novel mechanism moves the fixture 40 into place for transport through the aqueous wash machine 10.

The blades are demagnetized at the demagnetizing station to eliminate magnetic forces and thus allow for separation of the blades 54 from each other.

From the demagnitizing station, the blades are transported to a pre-wash station where fluid from the rinse station is employed to forcibly remove some of the contamination in bulk from the surface of each blade in the stack 54.

The blades in the stack 54 are then transported to a wash station where washing takes place using a heated aqueous cleaning solution which is sprayed through the nozzles at high pressure. The wash is a closed loop circulating system and the cleaning solution is heated by circulating through a heat exchanger which is of the steam type but may employ any other medium such as electricity, or hot water.

The blades 54 are then moved to a rinse station where they are sprayed with rinse water from the succeeding final rinse station through a plurality of nozzles under pressure. The blades 54 are then sent to a final rinse station where they are spray rinsed with heated purified city water using pressure to force the water through rinse nozzles.

At the first air dry station and during the latter course of travel through the final rinse station, the blades are blown with oil free dry heated compressed air to remove the bulk of the remaining rinse water from the surface of the blades by mechanical action, or air wiping, rather than by evaporation.

At the succeeding lamp dry station, the blades are subjected to a plurality of heat lamps which provide radiant heat to the stack of blades and the infra red lamps are employed to remove adsorbed water vapor.

At the final air drying station, an application similar to that produced in the preceding air dry station is repeated and any residual desorbed water vapor is blown from the surface of the blades.

From this station, the blades and their fixture are unloaded as they drop from the path of movement through the machine 10.

Thus, the purification of the water in the final rinse insures that the blades are substantially free of any contaminants not only contained on the original blade surface but from the water entering the wash or rinse stations. The separation of the various compartments is intended to prevent a contamination of a succeeding process from the fluid dispersed in a preceding station. The provision of separate drive means for transporting the articles from the pre-wash station through the wash and rinse stations, through the final rinse station and through the drying stations and the unloading area is effective to prevent any contamination which may be contained on the belt which transports the article from one load station to the next station, and thereby to prevent the movement of contamination with the belt.

The aqueous wash machine 10, therefore, and the process in which it operates, is effective to produce an article such as a razor blade which is free from contaminants. The washed razor blades can be subjected to an ion beam bombardment blade edge cleaning operation and to blade edge coating operations to deposit metal strengthening materials and lubricous materials on blade edges. Details relating to representative blade edge coating operations for depositing strengthening materials such as metals on blade edges can be found in commonly owned U.S. Pat. Nos. 3,761,372 and 3,835,537 which are incorporated herein by reference. Details relating to representative blade edge coating operations for coating lubricous materials such as polymeric materials on blade edges can be found in commonly owned U.S. Pat. No. 3,518,110 which is also incorporated herein by reference.

While it is obvious that modifications and changes may be made within the spirit and scope of the present invention, it is our intention, however, only to be limited by the scope of the appended claims.

As our invention, we claim:

1. A method of removing contamination from the surface of an article which includes the steps of:

moving the article along a continuous path through a pre-wash station, a wash station, a rinse station, a final rinse station, and a plurality of drying stations, applying a liquid to the surface of the article at each of the pre-wash, wash, rinse and final rinse stations;

providing an aqueous cleaning solution at the wash station and non-contaminated water for said application at the final rinse station;

circulating the applied water from the final rinse station to the rinse station for said application at the rinse station;

circulating the applied water from the rinse station to the pre-wash station for said application at the pre-wash station, removing rinse water from the article surface by blowing heated air onto the article at a drying station, each of said stations being separated by wall structure having an opening formed therein to provide for movement of the article therethrough, and at least one of the wall openings having air under pressure provided to form an air curtain adjacent said one of the wall openings, and removing adsorbed water vapor from the article surface at a subsequent drying station by subjecting the article to a plurality of heat lamps, and removing residual desorbed water vapor from the article at a next drying station.

2. A method as set forth in claim 1 wherein the pre-wash, wash, rinse and final rinse stations are each provided with a plurality of nozzles and the liquid is applied to the article surface under pressure through the nozzles.

3. A method as set forth in claim 2 wherein the non-contaminated water is heated to a temperature in the range of 140° F. to 160° F.

* * * * *